United States Patent [19]

Wiggins

[11] 4,216,760

[45] Aug. 12, 1980

[54] FIREPLACES

[76] Inventor: William H. Wiggins, 250 Don Park Rd. Unit 12, Markham, Ontario, Canada

[21] Appl. No.: 914,350

[22] Filed: Jun. 12, 1978

Related U.S. Application Data

[60] Division of Ser. No. 720,566, Sep. 7, 1976, which is a continuation-in-part of Ser. No. 549,837, Feb. 13, 1976, abandoned.

[51] Int. Cl.[2] ..... F24B 1/18

[52] U.S. Cl. ..... 126/120

[58] Field of Search ..... 126/120, 121, 62, 63

[56] References Cited

U.S. PATENT DOCUMENTS

| | | | |
|---|---|---|---|
| 167,497 | 9/1875 | Church | 126/63 |
| 3,220,400 | 11/1965 | Yager | 126/63 |
| 3,515,122 | 6/1970 | Andrews | 126/120 |
| 3,724,443 | 4/1973 | Carson | 126/121 |
| 3,952,721 | 4/1976 | Patterson | 126/120 |
| 3,986,488 | 10/1976 | Hannebaum | 126/120 |

*Primary Examiner*—Samuel Scott
*Assistant Examiner*—Wesley S. Ratliff, Jr.
*Attorney, Agent, or Firm*—Ridout & Maybee

[57] ABSTRACT

A fireplace has an imperforate dished fire-pan, the sloping sides of which support the fire, which radiates through an opening in the wall of a conical enclosure superposed on the fire-pan. An outer frustoconical casing in most cases surrounds the enclosure, with an opening in register with the opening in the disclosure, and defines an air circulation space through which air circulates upwardly from beneath the fire-pan up into the room. A duct from the exterior of the room to be heated may extend into the space beneath the fire-pan, which space may also contain a water pan to humidify the circulating air. A fire control member is rotatable between the enclosure and the casing so as optionally to obturate the openings therein with either a mesh fire screen or a plate closing off the openings. The fireplace aims to provide complete and controllable combustion of wood fuel, and efficient space heating and, optionally, ventilation of a room in which it is situated.

8 Claims, 11 Drawing Figures

FIREPLACES

REFERENCE TO RELATED APPLICATION

This is a division of application Ser. No. 720,566, filed Sept. 7, 1976, now abandoned which is application is a continuation-in-part of my co-pending application Ser. No. 549,837, filed Feb. 13, 1976.

FIELD OF THE INVENTION

The field of the invention is prefabricated metal fireplaces.

REVIEW OF THE PRIOR ART

Numerous designs of fireplace of essentially sheet metal construction are known, but all either require to be transferred from the factory to the user substantially in one piece, or are relatively complex to assemble. Moreover, even in fireplaces which do disassemble for transit, the combined bulk of the disassembled parts is considerable, resulting in increased shipping and storage costs. The fireplaces are relatively complicated to fabricate, and in most cases are not particularly effective as space heaters, often being more ornamental than practical.

Open fireplaces are commonly employed to burn wood, or possibly artificial firelogs as an alternative, and the design of efficient wood burning fireplaces has presented considerable problems because of the difficulty of obtaining complete combustion of the wood and avoiding blow backs and accumulations of "creosote" in flues and chimneys which present a fire hazard. Possibly the most effective woodburning fireplace yet devised is Benjamin Franklin's Pennsylvanian fireplace of which the inventor published an account as long ago as 1744. Unfortunately the original design is difficult to fabricate economically under present day conditions, and extensive modifications in the design which have been made to facilitate the production of present day "Franklin" fireplaces have seriously reduced their effectiveness. A number of other woodburning fireplace designs have been evolved, but all are less than ideal in appearance and/or performance and most are unsuited to economic fabrication from sheet metal in modern designs.

SUMMARY OF THE INVENTION

The present invention seeks to provide a fireplace which can burn wood efficiently and completely, which can be incorporated in an effective heating, ventilating and air conditioning system for a room or home, which is simple to fabricate and assemble, which is of neat appearance, which is easy to operate, and which can be packed compactly for shipping or storage.

In a first aspect, the invention provides a fireplace comprising an imperforate bowl shaped fire-pan having extended sloping sides to support fire building material, a fire enclosure superposed on an outer rim of the fire-pan, said enclosure including a generally conical hood tapering to a flue and defining an opening above the rim of the fire-pan to the exterior of the fireplace, the opening being positioned and dimensioned so that heat may be directly radiated through it from at least the central portion of the fire-pan to a substantial part of the environment of the fireplace. A fire built in such a fireplace conveniently includes a large first log laid across that sloping side of the fire-pan opposite the opening in the enclosure, and second and third smaller logs resting at their one ends on the first log and at their other ends on spaced locations on the sloping sides of the fire-pan to either side of the opening so that the logs frame the central area of the fire-pan as seen through the opening.

Such a fireplace structure has several advantages over conventional fireplaces in which the combustible material is either supported on a grate or placed on a flat open fronted hearth. With a grate, there is a relatively unobstructed air flow upward through the material, which tends to burn rather rapidly, whilst ashes drop through the grate and accumulate. With combustion on a flat hearth there is also an accumulation of ash and it may become difficult to maintain adequate combustion. With the bowl shaped fire-pan of the present invention, the sloping sides of the pan support the combustible material clear of the bottom of the pan and at the same time tend to direct any ash towards the bottom. However, it is found that the configuration of the pan also promotes gas flow which prevents excessive accumulations of ash, the lighter particles being entrained in the flue gases. The fireplace is thus substantially self cleaning. The bowl shape of the fire-pan also inhibits excess air flow past the combustible matter so that combustion takes place more completely and at a controlled rate which can be effectively reduced to a low rate without the fireplace structure above the fire-pan needing to be particularly gas tight. This controlled rate of combustion together with the configuration of the combustion chamber is also found to eliminate or greatly reduce creosote formation by causing more complete combustion of the gaseous decomposition products of the fuel.

The invention also extends to a fireplace comprising a fire-pan, a generally conical fire enclosure extending upwardly from the fire-pan to a flue and having a side opening, a general frustoconical casing concentrically surrounding the fire enclosure and having a side opening in register with the opening in the fire enclosure, and a fire door assembly rotatably supported concentrically intermediate between the enclosure and the casing, said assembly comprising a frame having portions projecting above and outwardly of the top of the frustoconical casing, a mesh screen and a door plate each supported by said frame and each bounding sufficient of the periphery of the conical enclosure to be rotatable into a position obturating the opening therein, a sufficient portion of the periphery of the enclosure being unbounded by either the screen or the plate to permit the frame to be rotated so that at least a substantial portion of the opening in the enclosure is unobturated.

This arrangement provides a fireplace with a particularly comprehensive method of controlling the fire. It is especially advantageous when employed with the dished grateless fire-pan referred to above with which it enables a high degree of control to be exercised on the rate of combustion of the fire even though the seals between the fire door assembly, and the fire enclosure and the fire-pan are not fully airtight.

The invention further extends to a fireplace comprising an imperforate fire-pan, a fire enclosure extending upwardly from the rim of the fire-pan to a flue extending out of a room in which the fireplace is installed, an opening defined by the wall of the fire enclosure, an outer casing surrounding the fire enclosure and defining an air circulation space between the casing and the enclosure extending from a bottom opening from the atmosphere of the room beneath the fire-pan to a top opening to the room above the fire enclosure, said outer casing having an intermediate opening in register with the opening in the enclosure, and a fresh air vent extending into the bottom opening of the outer casing from outside the room, whereby air from both outside the room and from beneath the fire-pan inside the room may convect through the circulation space and into the room at a higher level, and air from an intermediate level in the room may exhaust through the intermediate opening in the casing, the opening in the fire enclosure, and the flue.

By this arrangement, the fireplace may be incorporated in a comprehensive heating and ventilation system, and by the further addition of a water pan beneath the fire pan the air circulating through the room may be conditioned by addition of humidity.

SHORT DESCRIPTION OF THE DRAWINGS

The invention is described further with reference to the accompanying drawings, wherein:

FIG. 1 shows a perspective view of a first embodiment of fireplace in accordance with the invention, FIG. 2 is a plan view of the same fireplace, FIG. 3 is a view corresponding to FIG. 1, showing the fireplace with the addition of an outer casing, FIG. 4 is a vertical section through the fireplace of FIG. 3, FIG. 5 is a vertical section through the fireplace of FIG. 3, packed for transit, FIG. 6 is a perspective view of a modified form of the fireplace, FIG. 7 is an exploded perspective view of the fireplace of FIG. 6, FIG. 8 is a vertical section through the fireplace of FIG. 6, on the line 8—8 in FIG. 7, FIG. 9 is a vertical section through the fireplace of FIG. 6, packed for transit, FIGS. 10 and 11 are cross-sectional diagrams illustrating use of the fireplaces for space heating purposes.

DESCRIPTION OF THE PREFERRED EMBODIMENT

Figure 1:
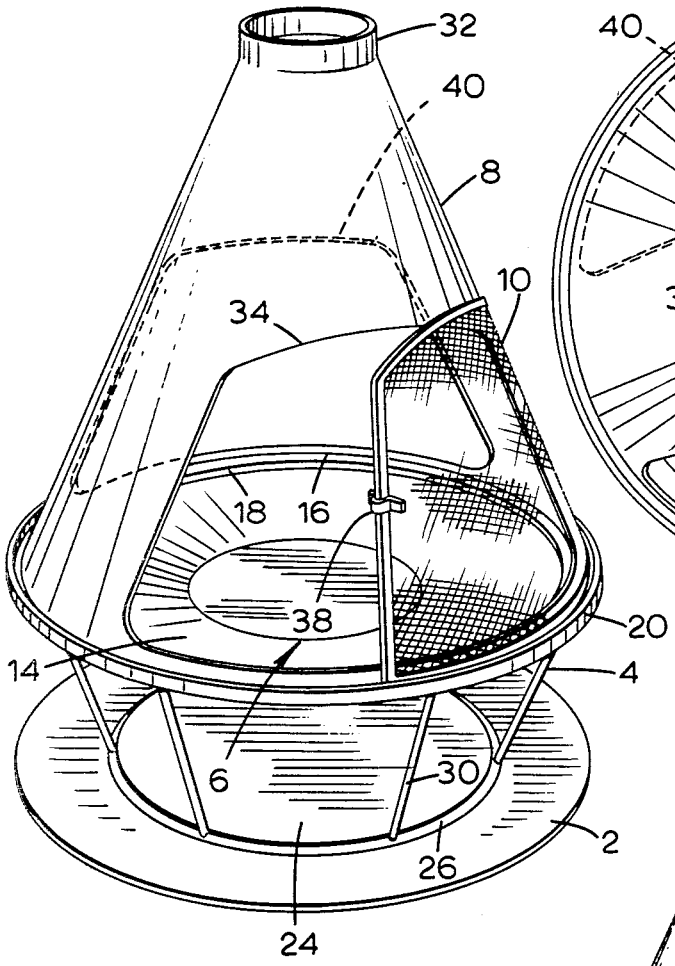
Figure 2:
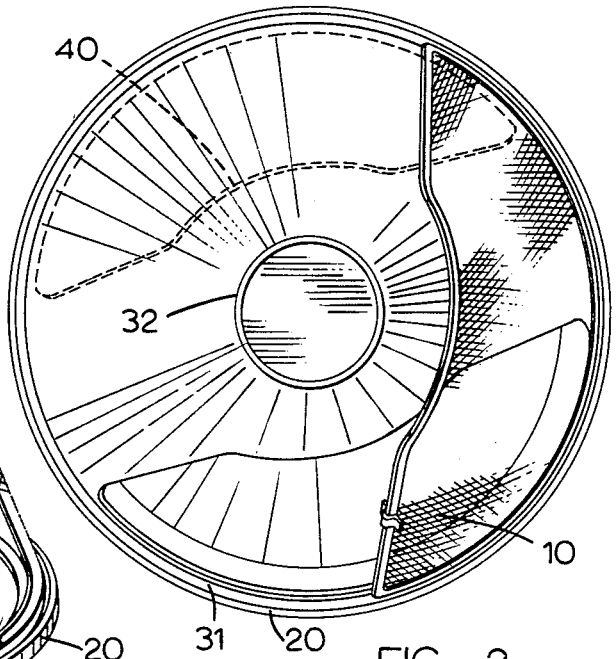
Figure 3:
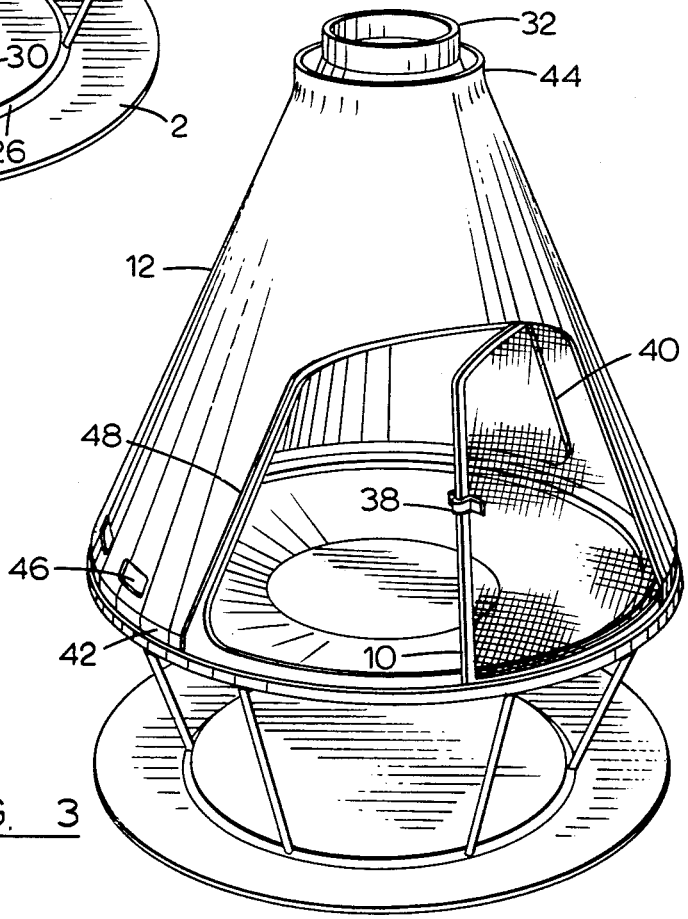
Figure 6:
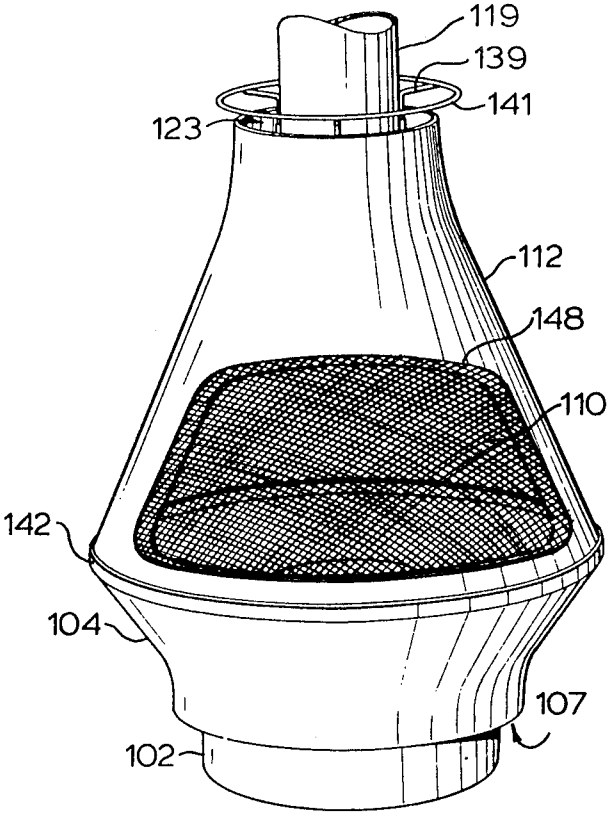
Figure 4:
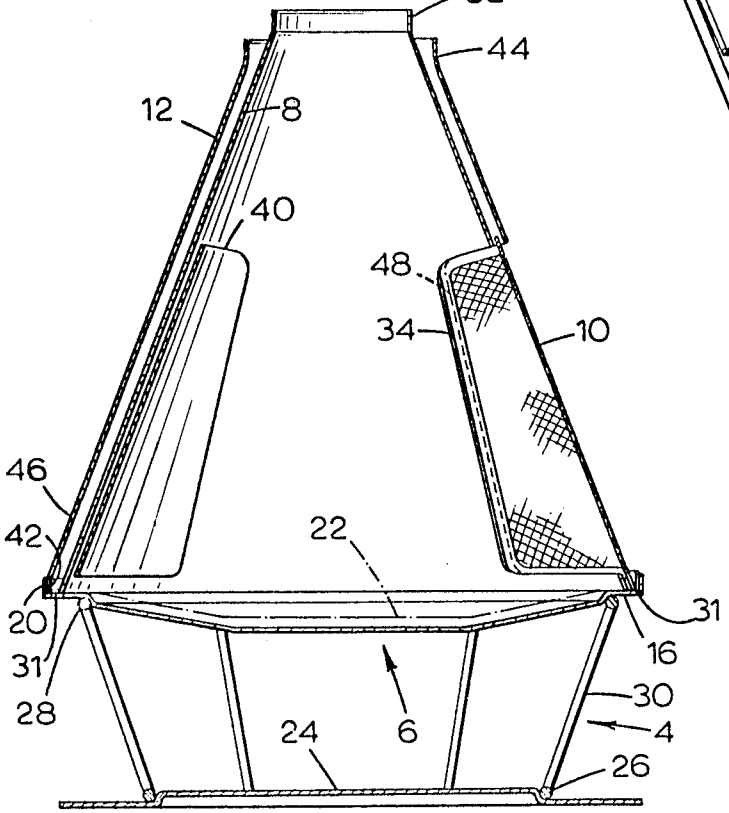
Figure 7:
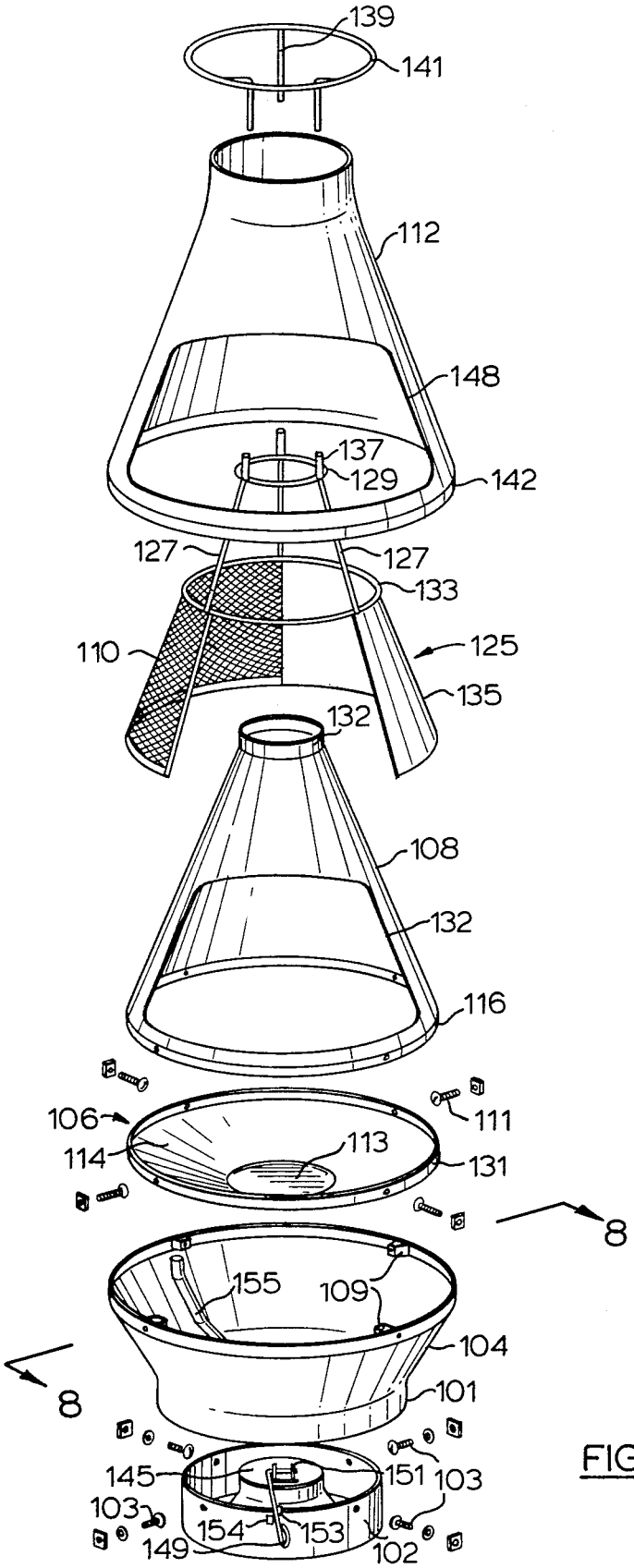
Figure 8:
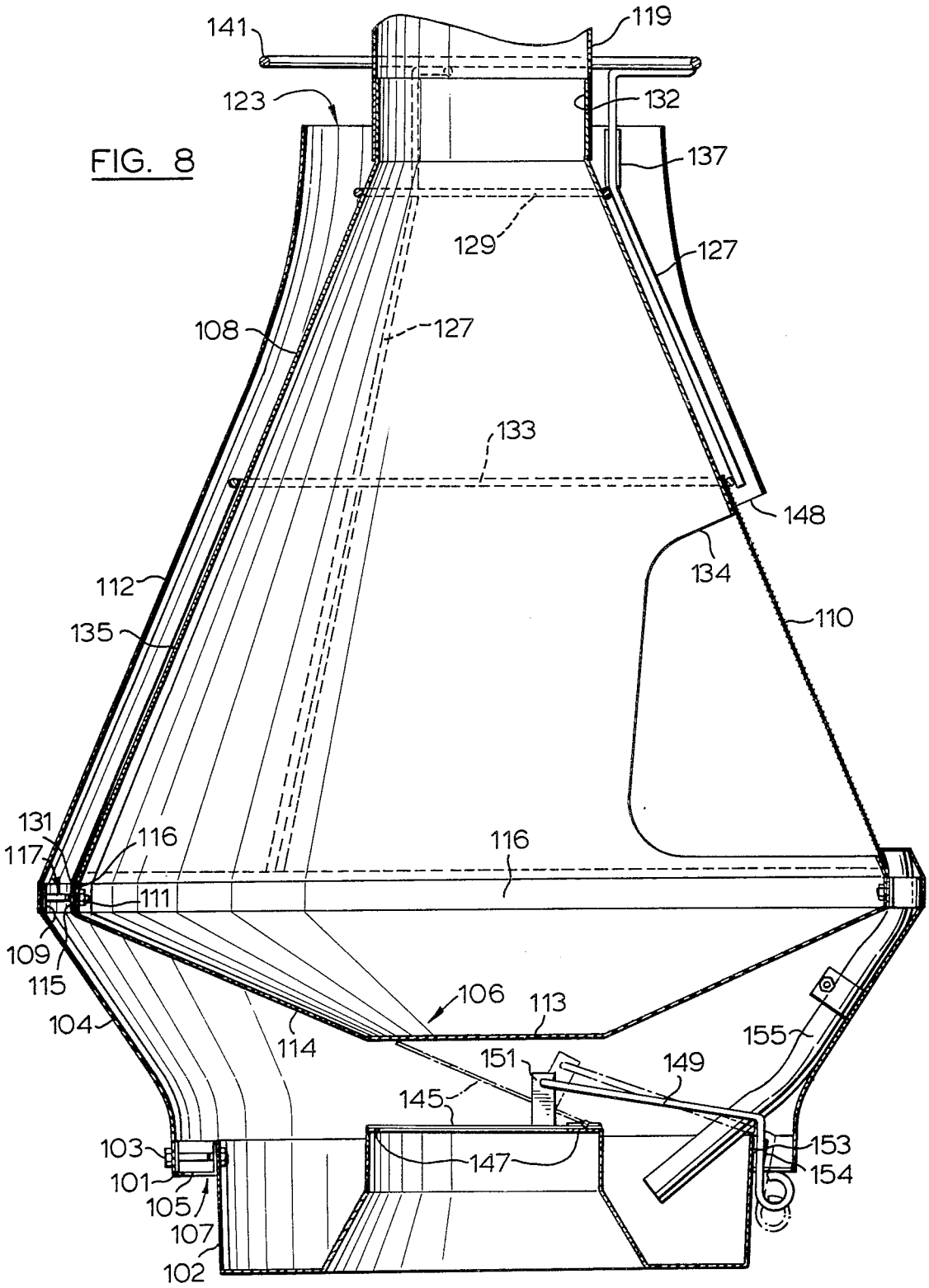

Referring to FIGS. 1 to 4, a fireplace is shown which comprises a baseplate 2, an open work spacer member 4, a fire-pan 6, a hood formed by a conical enclosure 8, a fire screen 10 and, in the case of FIGS. 3 and 4, a frusto-conical casing 12.

The dished fire-pan 6 receives the fire directly and is flow turned from heavy gauge sheet steel, a small central portion 13 being connected to a surrounding rim 16 by a sloping wall 14, the rim 16 being connected to the wall 14 by an annular step 18, and being surrounded by an upturned annular flange 20. In use, the central portion 13 and wall 14 may be covered with a layer of fire clay or equivalent refractory material 22 (shown in broken lines in FIG. 10) in which case a lighter gauge of steel may be used for the pan. Flow turning is a metal forming process which differs from spinning in that only a single forming pass is involved, rather than the successive deformations carried out by the various forming passes during spinning. In flow turning, coacting forming tools are moved gradually outwards relative to a rotating metal workpiece as the forming pass proceeds, and the forming pressures are much higher than those used in spinning. As compared with spinning, flow turning has the advantage of enabling much deeper conical configurations to be formed, and also enables an unworked and undeformed flange to be left at the external periphery of the formed workpiece. The technique of flow turning is sometimes known as shear forming or roll forming.

The base 2 is a circular disc of sheet metal with a raised central circular portion 24, the step between the portion 24 and the remainder of the disc serving to locate a base ring 26 of the open work spacer 4. This spacer consists of the base ring 26, a larger diameter top ring 28, and a number of rods 30 connecting the base and top rings. The spacer is fabricated from steel rod and has an inverted frusto-conical configuration. The step 18 of the fire-pan 6 is located within the top ring 28, thus firmly locating the fire-pan in relation to the base. Instead of providing the step 18, locating brackets may be welded to the underside of the fire-pan, the spacer being releasably locked to the pan by a snib pivotally mounted beneath the latter.

Standing on the fire-pan 6 is a fire enclosure which in this embodiment consists solely of the cone 8. This cone is formed from sheet steel by a flow turning process, a horizontally extending flange 31 of the original sheet being left at the bottom of the cone, this flange resting on the rim 16 so as to locate the base of the cone 8 within the flange 20. For greater security, the cone may be releasably retained within the pan by detents in the form of tongues punched inwardly from the flange 20 of the fire-pan. The apex of the cone is truncated and formed with a vertical annular flange 32 which enables connection to be made to a flue pipe (not shown).

An opening 34 is cut in the wall of the cone 8, the opening being large enough to expose the greater part of the fire-pan 6 (see FIG. 1), and to shield this opening against flying sparks when a fire is burning in the fire-pan, the fire screen 10 is provided. The fire screen 10 is of generally similar shape to the opening 34, but slightly larger, and rests in the channel 38 formed between the cone 8 and the flange 20, the fire screen being movable in the channel by means of a handle 38 so as to expose a greater or lesser portion of the opening 34.

The portion of the cone 8 cut away in order to form the opening 34 is welded within the opposite side of the cone so as to form a fire back 40 which shields the cone 8 from overheating by the fire and possible damage.

In order to increase the efficiency of the fire as a space heater, an additional component is preferably added to the hood in the form of a frusto-conical casing 12. This is formed by flow turning in the same manner as the cone 8, but its configuration differs slightly. The base of the frustum is slightly wider than that of the cone and is formed with a depending flange 42 which rests within the flange 20 and supports the casing so as to leave an air gap between it and the cone 8. An annular top flange 44 is flared into the frustum and is of substantially greater diameter than the flange 32 so as to leave an annular air gap between the two flanges. Air vents 46 are formed in the rear of the casing towards its lower end, and an opening 48 is provided corresponding to and registerable with the opening 34.

In order to assemble the fireplace, the various components are merely stacked coaxially one upon the other. Indeed, assembly and disassembly is so easy that the user of the fireplace may readily disassemble it for movement between different locations, for example for alternative use in an indoor location in connection with a permanently installed flue, or in an outdoor location in which it may if desired be converted into a barbecue by placing a gridiron over the fire-pan. Likewise, the ease of assembly and disassembly allows the fireplace to be stored away during the summer months if desired. The structure is perfectly stable without the optional snib and detents referred to previously but their presence may be preferred for added security.

Figure 5:
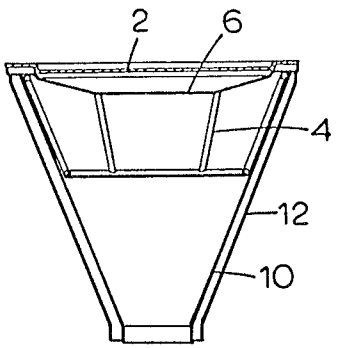

The possibilities discussed in the preceding paragraph are still further enhanced by the ease with which the fireplace may be packed into a compact space for transportation or storage. A section of the fireplace in its packed condition is shown in FIG. 5, in which it will be seen that the casing 12 (if used) is inverted, the inverted cone 8 is dropped within the enclosure, the open work spacer 4 is dropped within the cone 8, the fire-pan is placed on the flange 30 of the cone 8 so that the dished portion 14 projects within the cone, and the base 2 is inverted and placed in the fire-pan. The fire door 36 may be packed either between the cone and the casing, as shown, or within the cone 8. It will be seen that the entire fireplace in packed form need occupy no more space than the casing 12 alone, or the cone 8 if the casing is not provided.

Operation of the fireplace when in use is generally conventional, except that the fire is built directly in the fire-pan 6. It should be observed that the open work spacer 4 leaves unobstructed the entire under surface of the fire-pan 6, thus permitting maximum emission of heat by radiation and convection from this surface. When the casing 12 is used, the fireplace becomes an even more effective space heater, with air entering the space between the cone 8 and the casing 12 through the gap between the edges of the openings 34 and 48 and through the air vents 46, and leaving through the gap between the flanges 32 and 44. A further advantage of using the casing is that since it is insulated from the cone by an air space, its temperature remains relatively low. Not only is this desirable from the point of view of safety, but it means that decorative finishes such as heat resistant paint may be applied to the outer surface of the casing 12, whereas only vitreous and other expensive refractory finishes would be suitable for the outer surface of the cone 8. The use of paint rather than a refractory finish represents an important economy in manufacture.

Figure 10:
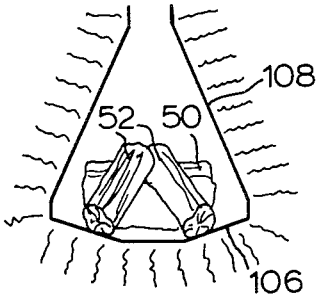
Figure 11:
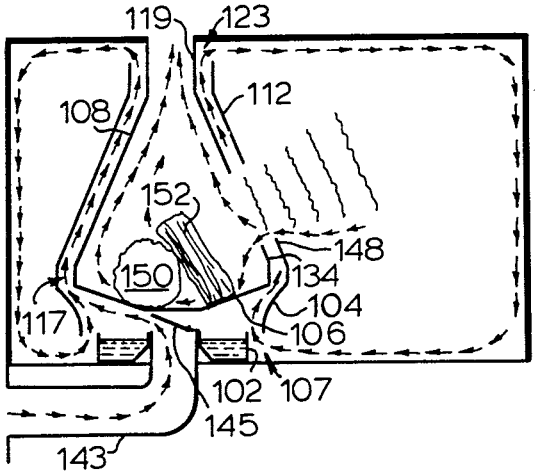

The fire is built so that its materials rest on the sloping wall 14 as seen in FIGS. 10 and 11; a preferred log arrangement when burning wood has a large back log 50 resting across the back of wall 14 and two smaller logs 52 resting on the back log and upon the front portion of wall 14 to either side of opening 34. The sloping wall 14 tends to direct ashes downwards towards central portion 13 of the fire-pan, completing combustion of wood to fly ash, and it is found that the airflow from opening 34 through the fire-pan and the interior of the enclosure to the flue is such as to make the fire substantially self cleaning, the fly ash being entrained and removed through the flue. It is found that combustion of the gases from the burning wood is much more complete, because these gases entrain further air from opening 34 for a secondary combustion process in the enclosure above the fire. This increases efficiency and reduces the possibility of creosote accumulation. For these advantages to be obtained the wood must be burned directly in the fire-pan without the use of a grate.

A more sophisticated embodiment of the fireplace is shown in FIGS. 6–9, in which corresponding parts have the same reference numerals increased by the addition of 100. The baseplate 2 is replaced by a base member which is an annular trough 102, and the spacer member is replaced by an inverted frusto-conical skirt 104 with a vertical bottom flange 101 flared into the frustum. This flare is produced by post-flow-turning expansion of the metal of the small end of the frustum, as is the case with other flared components used in the fireplace. The skirt is supported from the base member by bolts 103 passing through spacer brackets secured within the flange 101, so as to define an annular opening 107 into a space within the skirt and beneath the fire-pan 106.

The fire-pan is supported within an upper flange 109 on the skirt by means of bolts 111 passing through spacers 115 and a rim 116 of the fire-pan, so that a further annular opening 117 is defined between the rim 116 and the flange 109. The fire-pan requires no annular step corresponding to the step 18 but is otherwise similar in configuration to the fire-pan 6.

The lower flange 131 of a conical enclosure 108 is also secured by the bolts 111 so as closely to surround the rim 116 of the fire-pan. Apart from the configuration of the flange 131, the enclosure 108 is similar to the enclosure 8, with a top flange 132 for connection to a flue pipe 119, and an opening 134.

The casing 112 is substantially the same as the casing 12, but it includes no vents corresponding to the vents 46. Instead, it rests with its lower flange 142 closely surrounding the flange 109 of the skirt so that the annular opening 117 opens into the space 121 between the casing and the enclosure, thus defining a continuous air passage surrounding the fire-pan 106 and enclosure 108 from the opening 107 adjacent the bottom of the skirt 104 to the opening 123 adjacent the top of the casing 112.

The fire screen 110 forms part of a fire control assembly housed in the space 121. The assembly comprises a tripod rod framework, with three diverging legs 127 connected by upper and lower annuli 129 and 133, the lower annulus 133 being above the level of the top of the openings 134 in the enclosure 108 and 148 in the casing 112. Extending downwardly from the annulus 133 between and downwardly from two of the legs 127 is the fire screen 110, and a metal fire door 135 extends similarly between and downwardly from an adjacent two of the legs. The fire screen 110 is of expanded metal, oriented so that when the fireplace is viewed from in front (i.e. the side with the openings 134 and 148) and above, the mesh of the expanded metal when the screen obturates the openings causes minimum obscuration of an observer's view of the fire-pan 106. The tops of the legs 127 are bent so as to extend vertically and are fitted with tubular sockets 137 to receive spokes 139 of an annular operating handle 141 supported by the spokes radially outwardly of the opening 123. The assembly is supported on the enclosure 108 by the annuli 129 and 133, its centre of gravity being such that the door 135 tends to rest against the enclosure.

In a preferred arrangement, the opening 141, bounded by the annular trough member 102, is connected, as best seen in FIG. 11, to the outside of a building in which the fireplace is installed by means of a duct 143 through which air may enter the space beneath the fire-pan 106 to mix with air entering through the opening 107. Admission of such external air to the space is controlled by a flap valve 145 connected by a hinge 147 to an inturned flange on member 102. The valve may be moved to alternative open or closed positions by means of an operating handle 149 pivotally connected to a bracket 151 on the valve, which handle may be manually hooked over alternative brackets 153 and 154 on the outer margin of member 102 to define the open and closed positions. The valve is hinged at its front edge so as to direct the main incoming airflow rearwardly away from the opening 134.

The trough member 102 may be filled with water through a filler pipe 155 mounted on the skirt 104, by means of a funnel inserted into the top end of the pipe between the bottom edges of the openings 134 and 148. A dip-stick (not shown) may be provided to gauge the water level in the trough member, and may include a cap to close the top of the pipe.

As in the case of the previous embodiment, many of the components may be flow turned, thus producing seamless components of superior quality at moderate cost.

Figure 9:
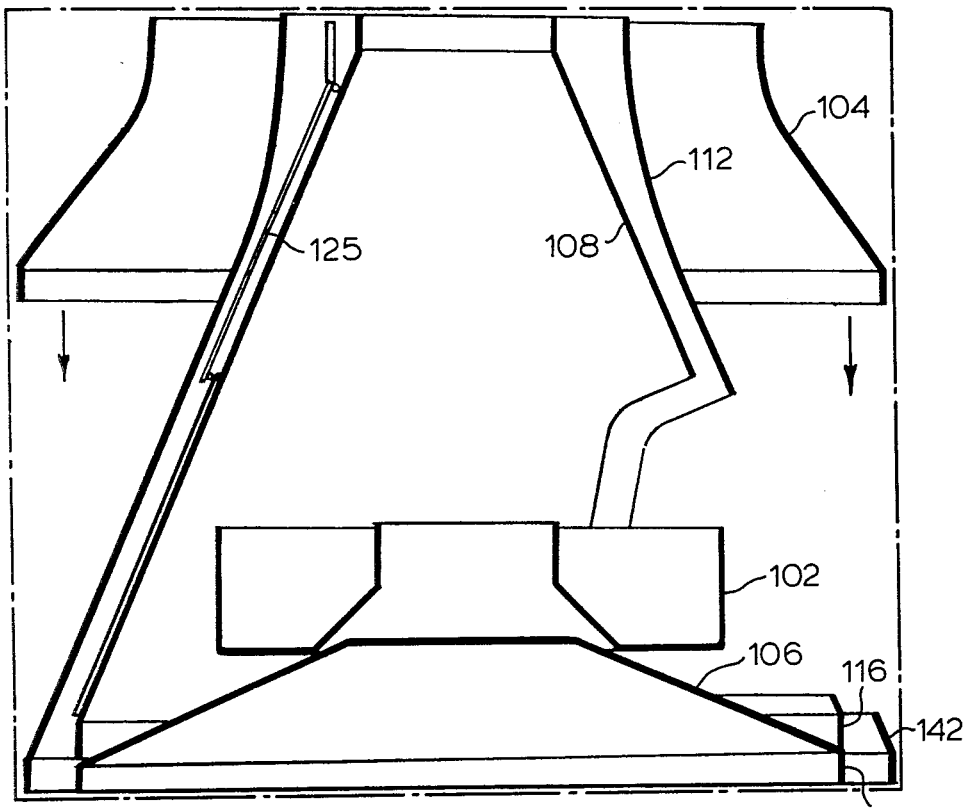

Referring to FIG. 9, it will be seen that the various components may be packed for transit in a similar manner to that described for the first embodiment with respect to FIG. 5. Indeed, in spite of the greater complexity of the fireplace structure, it occupies no more space when packed and will in fact fit in boxes originally designed to accommodate the embodiments of FIGS. 1–5.

The fireplace of FIGS. 6–9 may be operated as already described with reference to FIG. 10, but further features of its operation will be apparent from FIG. 11. It will be seen that, when the flap valve 145 is open, air from the duct 143 will enter the space between the fire-pan 106 and blend with air entering from the room in which the stove is located through the opening 107, whence under the influence of heat transmitted to it from the fire-pan 106 and the enclosure 108 it will convect upwardly through the opening 126 and then circulate around the room as indicated by the arrows before re-entering the opening 107. Stale air from the central area of the room will pass through the openings 134 and 148 to provide combustion air for the fire, and will be exhausted up the flue. The recirculating air will be humidified by picking up moisture evaporated from the water in the trough member 102, evaporation being assisted by the heat radiated downwardly by the fire-pan 106. There will be some admixture of air around the edges of the openings 134 and 148, but this will not significantly affect the operation.

The fire may be controlled by rotating the assembly 125. The assembly may be moved to a first, normal position, in which the screen 110 is framed in the openings 134 and 148 and forms a fireguard, or so that neither the screen 110 nor the door 135 appears in the openings so the fire may be stoked. When it is desired to reduce the rate of combustion, as for overnight operation, the door is moved into the opening so that air flow into the enclosure is reduced to a low level. Since with the present fireplace only a relatively small proportion of the air entering the enclosure actually passes through the fire, much greater leakage can occur than would be permissible with conventional stoves which can be closed for overnight burning. Leakage around the door will be reduced in any event since the position of the centre of gravity of the assembly 125 will tend to bias the door into contact with the enclosure 106. By moving the door so that it renders the opening 134 relatively narrow, it may be used to induce an accelerated draught when a fire is being lit. Because the operating handle 141 is radially outward of the opening 123 it does not become uncomfortably hot whilst being accessible and easy to operate.

What I claim is :

1. A fireplace comprising a plurality of components arranged coaxially one above another, including a stand, an imperforate dished fire-pan forming a grateless fire box to receive a fire and supported by the stand, the stand being configured to permit unobstructed convection of air over the whole of the lower surface of the fire-pan, a fire enclosure standing on the fire-pan, the fire enclosure comprising a cone tapering from a base, of substantially the same dimensions of the fire-pan and extending around the full periphery of the cone, to a flue opening at its upper end, the cone defining an opening above and to one side of the upper surface of the fire-pan, a generally frusto-conical casing covering the cone and defining an air circulation space surrounding the cone, the casing having an opening in register with that in the cone, and a screen member provided between the cone and the casing to close the openings defined in said cone and said casing, wherein the casing terminates in a top flange of greater diameter than the flue opening of the cone, so as to define an air gap between the flange and the flue opening, and the lower end of the casing is configured to provide an air entry to the air space between the casing and the cone, and wherein the components of the fireplace are stackable coaxially one within another in an alternative overlapping relationship for transit.

2. A fireplace according to claim 1, wherein the flue extends out of the room in which the fireplace is installed, and a fresh air vent extends into the bottom opening of the outer casing from outside the room, whereby air from both outside the room and from beneath the fire-pan inside the room may convect through the circulation space and into the room at a higher level, and air from an intermediate level in the room may exhaust through opening in the casing, the opening in the cone, and the flue.

3. A fireplace according to claim 2, wherein the fresh air vent is provided with a flap valve controlling the flow of air therethrough.

4. A fireplace according to claim 2, further comprising a water trough within the outer casing beneath the fire-pan, whereby water from the trough is evaporated into the air convecting through the circulation space.

5. A fireplace according to claim 4, wherein the water trough is annular, and surrounds the fresh air vent.

6. A fireplace according to claim 5, wherein the water trough forms a base upon which the remainder of the fireplace is supported.

7. A fireplace according to claim 1, wherein the opening in the fire cone is formed by cutting away a portion of one side of the cone just above but not intersecting its lower edge, the cut away portion of the cone being secured as a heat shield to the inner surface of the opposite side of the cone.

8. A fireplace according to claim 1, wherein the cone and the casing are both flow turned.

* * * * *